US005932071A

United States Patent [19]

Stielow et al.

[11] Patent Number: 5,932,071

[45] Date of Patent: Aug. 3, 1999

[54] DANDY ROLL WITH A GRID OF DIAMOND SHAPES

[75] Inventors: Richard C. Stielow, Neenah; Jeffrey R. Miller, Appleton; John E. Gutzwiller, Neenah; Kathy A. Merckx; Mark P. Kleman, both of Appleton; Mark S. Johnston, Neenah, all of Wis.

[73] Assignee: The Mead Corporation, Dayton, Ohio

[21] Appl. No.: 08/902,539

[22] Filed: Jul. 22, 1997

[51] Int. Cl.[6] ..... D21F 1/46

[52] U.S. Cl. ..... 162/314; 492/32; 162/308

[58] Field of Search ..... 162/110, 314, 162/296, 308, 312, 313; 492/32

[56] References Cited

U.S. PATENT DOCUMENTS 353,666 12/1886 Crane, Jr. .

1,571,715 11/1925 Fearing .

1,616,222 2/1927 Harrrigan .

2,998,846 9/1961 Hornbostel ..... 162/297

4,462,867 7/1984 Fuller ..... 162/103

4,526,652 7/1985 Waters ..... 162/110

5,100,512 3/1992 Waters ..... 162/110

*Primary Examiner*—Peter Chin

*Assistant Examiner*—Steven B. Leavitt

*Attorney, Agent, or Firm*—Thompson Hine & Flory LLP

[57] ABSTRACT

Paper bearing a unique watermark having a grid pattern of translucent lines and repeating translucent diamond shapes at alternating intersections of the lines produced using a dandy roll in which the outer grid comprises a rectangular grid pattern where alternate intersections are provided with substantially diamond shapes.

1 Claim, 3 Drawing Sheets

DANDY ROLL WITH A GRID OF DIAMOND SHAPES

BACKGROUND OF THE INVENTION

1. Field of the Invention

The present invention relates to a dandy roll useful in producing paper bearing a watermark having a grid pattern of translucent lines and repeating translucent diamond shapes at alternating intersections of the lines.

2. Introduction

In papermaking, watermarks are conventionally formed by contacting the paper stock while it is still damp with a dandy roll having raised and/or recessed areas on the surface. An opaque mark known as a "shaded mark" is formed on the paper in areas contacting the recesses on the surface of the dandy roll and is the result of pulp fibers accumulating in the recesses as the paper stock travels under the dandy roll on the papermaking machine. Translucent marks, known as "wire marks," are formed in the paper in areas contacting the raised areas on the surface of the dandy roll. These marks are the result of the raised surface of the roll displacing the fibers in the stock resulting in areas in which the fibers are less concentrated and the paper is more translucent.

It is conventional in the art to form shaded marks by depressing the surface of the wire screen forming the dandy roll and to form wire marks by soldering wire segments, known as electro wires, to the surface of the dandy roll screen. See, for example, U.S. Pat. No. 353,666 to Z. Crane, Jr. (1886) and U.S. Pat. No. 1,571,715 to Fearing (1926). It has also been known to watermark paper by altering the draining rate of the Fourdrinier screen by modifying the weave in the screen such as by using larger gauge wire to form the screen or by omitting a wire from the screen altogether. See, for example, U.S. Pat. No. 1,616,222 to Harrigan (1927).

U.S. Pat. No. 4,526,652 to Waters, discloses a papermaking process wherein paper bearing the look of an oxford cloth weave is produced. The oxford cloth simulation is achieved by positioning narrow pockets and electro wires along the circumferential and longitudinal axis of a plain weave dandy roll screen.

U.S. Pat. No. 5,100,512 to Waters, discloses a papermaking process wherein paper bearing a unique watermark is produced using a dandy roll having a screen in which the widthwise fill (shute) wires are woven in a one over then two under pattern with lengthwise warp wires such that a longer warp knuckle results on the side of the screen in contact with the passing paper stock.

SUMMARY OF THE INVENTION

An object of the present invention is to provide a dandy roll which is useful in manufacturing paper bearing a unique watermark wherein the dandy roll employs a screen having diamond-shaped deposits at alternate intersections of the wires.

This and other objects of the present invention will become apparent from the following description of the invention.

DESCRIPTION OF THE PREFERRED EMBODIMENT

Figure 1:
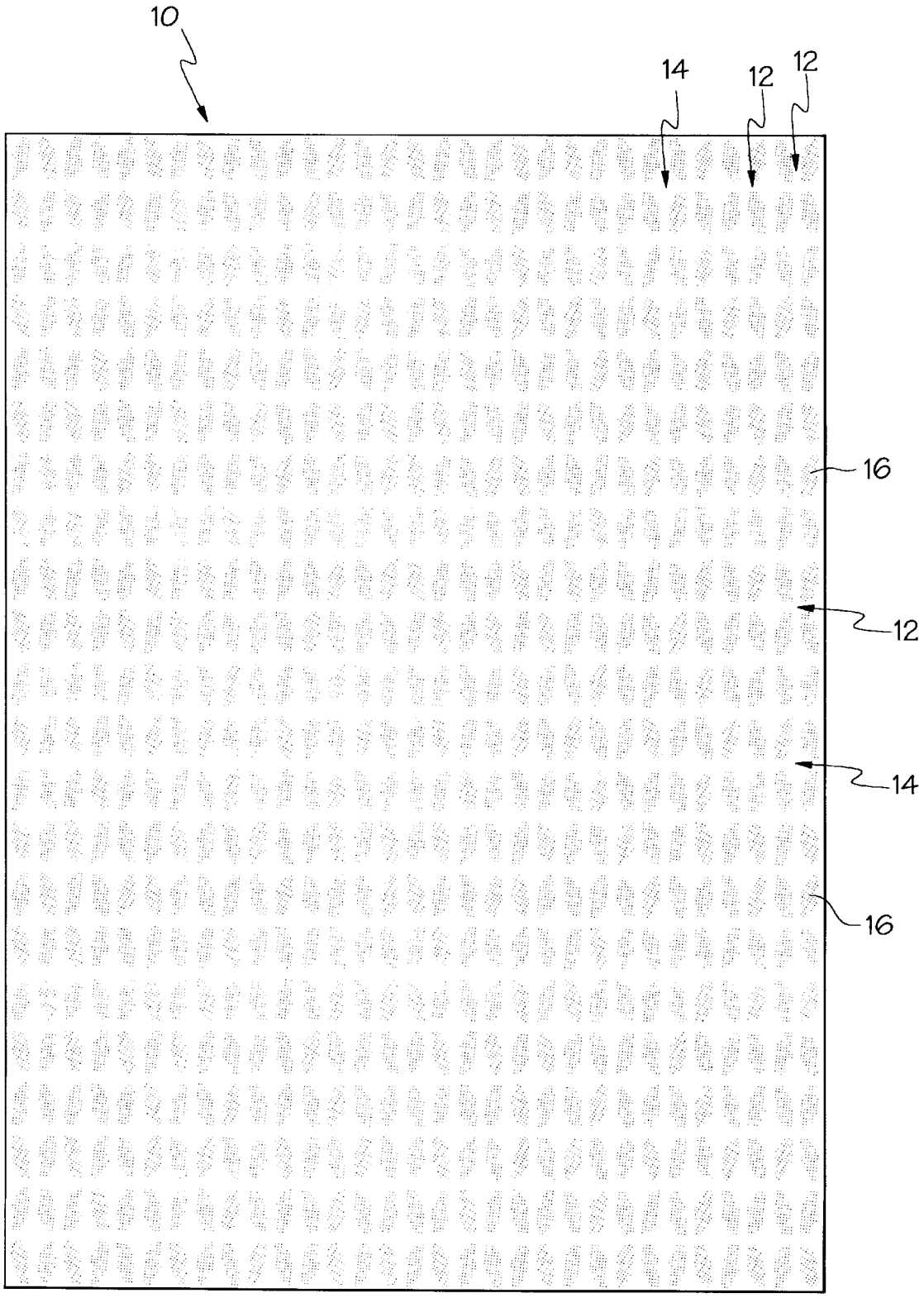
FIG. 1 is a top plan view of a sheet of paper manufactured in accordance with the present invention bearing a watermark having a grid pattern of lines and repeating diamond shapes at alternating intersections of the lines.

FIG. 1 illustrates a paper bearing the type of watermark produced in accordance with the present invention.

In FIG. 1, a paper sheet 10 is shown bearing a watermark having a background grid consisting of intersecting translucent lines 12 and distinctive, repeating translucent diamond shapes 14 at alternating intersections of the lines 12; and "shaded marks" 16 uniformly interspersed throughout the grid. In addition to the simulated grid pattern, the paper may bear one or more conventional watermarks such as the name of a paper manufacturer, a company logo, or the like (not shown).

The paper of FIG. 1 is manufactured using the dandy roll 18 of the present invention in conjunction with standard papermaking techniques. The dandy roll 18 is usually positioned near the end of the papermaking machine where the paper stock leaves the wire, as is conventional in the art. At this point, the stock is sufficiently damp that the fibers forming the paper can be displaced by the surface of the dandy roll 18. A typical arrangement is shown in FIG. 4 where paper web 20 is supported on a paper making wire which travels on rollers 22 as it passes into contact with the dandy roll 18.

Figure 2:
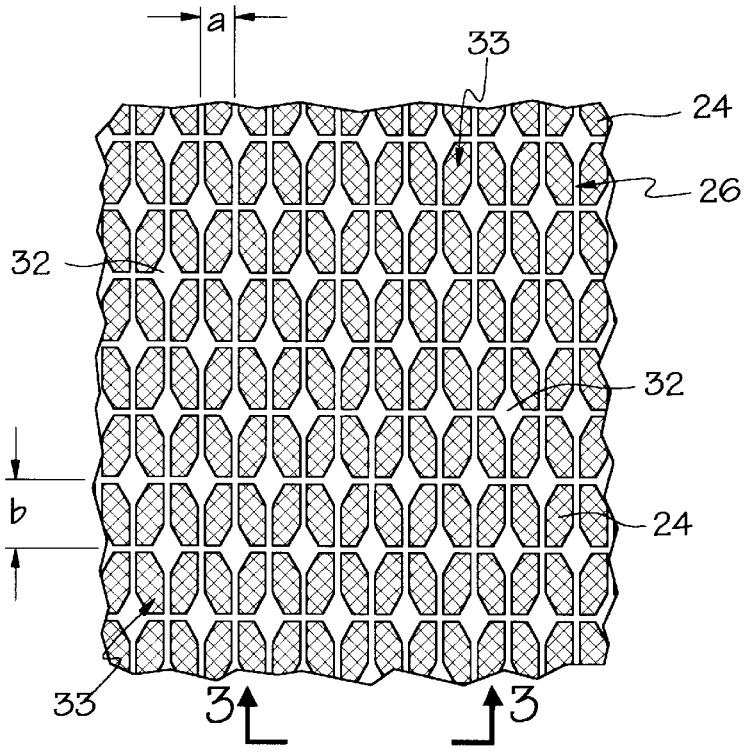
FIG. 2 is an overhead view of a dandy roll screen in accordance with the present invention.
Figure 3:
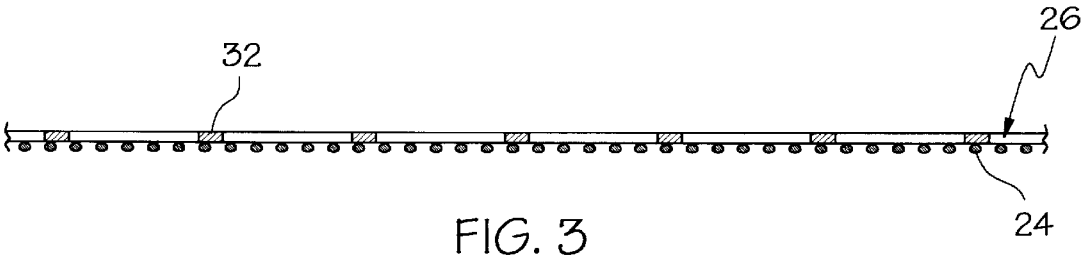
FIG. 3 is a cross sectional view of the dandy roll screen of FIG. 1 along the lengthwise axis of the dandy roll screen.
Figure 4:
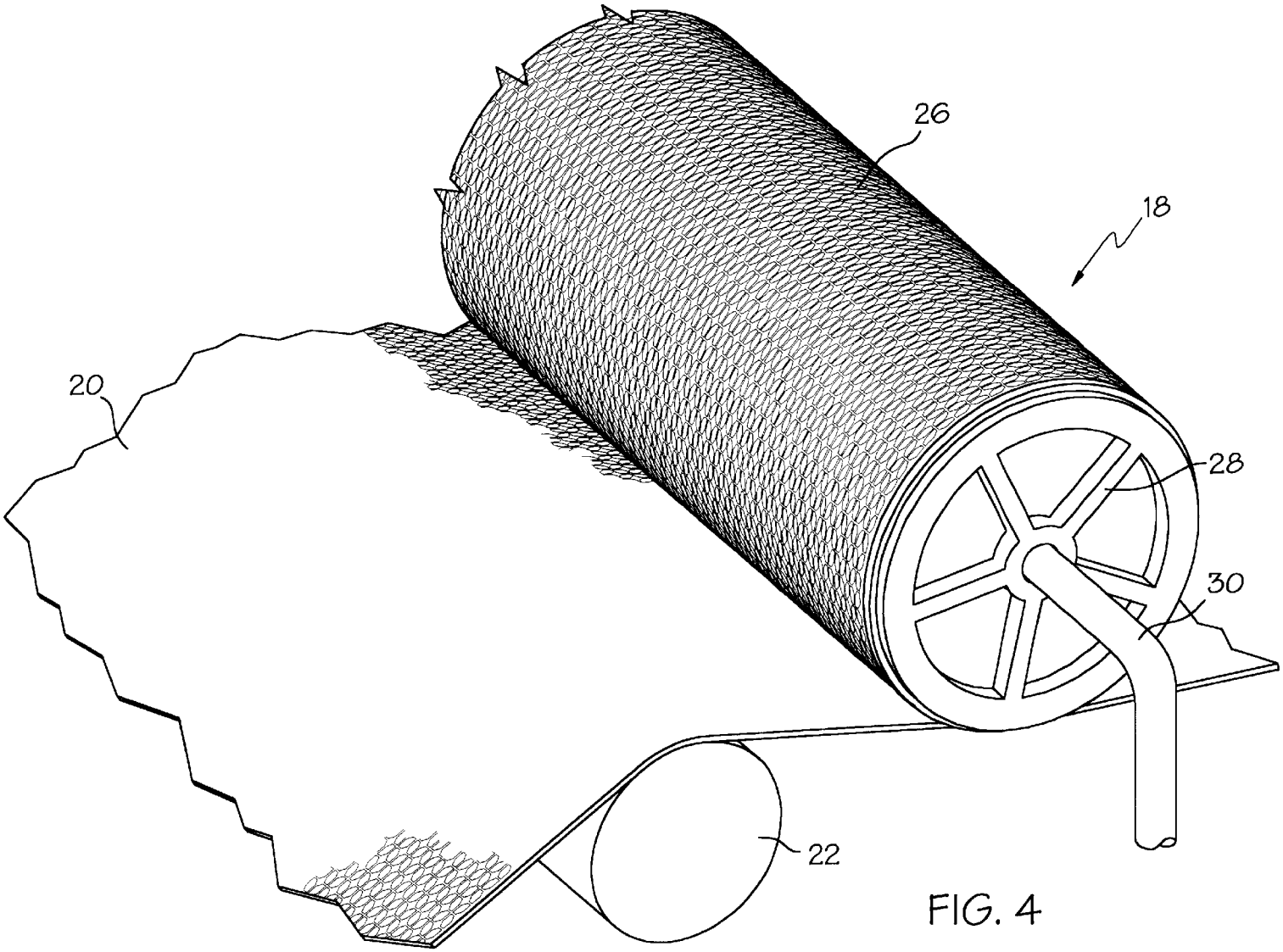
FIG. 4 is a perspective view of a dandy roll in accordance with the present invention on a conventional papermaking machine.

As shown in FIGS. 2, 3 and 4, the dandy roll 18 is constructed of a cylindrical frame, which is wrapped with an inner wire mesh cover 24, which functions as a support and bonding surface for an outer grid 26. The cylindrical frame can be of any suitable circumference, but it is typically about 22 inches. The dandy roll frame can be constructed in a conventional manner. To provide rigidity, a large diameter spiral truss wire (not shown) is wound in either clockwise or counter-clockwise direction between two bronze spidered heads 28 (one shown) on each end of the dandy roll. Longitudinal braces (not shown) are typically welded across the length of the roll between the spidered heads 28. Each spidered head 28 has a journal 30 protruding from its center which holds the dandy roll 18 in place on the papermaking machine. These journals are not necessary if the dandy roll 18 is mounted with a trunnion drive, in which case the dandy heads are not spidered but have a concave groove around each open head which matches the trunnion drive wheel. The inner wire mesh cover 24 is spirally wound around the circumference of the roll in the direction opposite the windings of the truss wire. The inner wire mesh cover 24 may have a conventional plain weave. The mesh size of the inner wire mesh cover 24 may vary from about 10 mesh per inch to about 24 mesh per inch, and is typically about 18 mesh per inch. Any suitable material known in the art may be used for the inner wire mesh cover 24.

The outer grid 26 bears the grid pattern, which comes in contact with the paper and is affixed to the cylindrical frame by soldering the screen 26 to the spidered heads 28 and the inner wire mesh cover 24. The edges of the outer grid 26 are seamed along the length of the roll. The cylindrical frame in combination with the inner wire mesh cover 24 and the outer grid 26 can be of any suitable circumference, preferably about 44 inches.

To produce the watermark shown in FIG. 1, the outer wire screen 26 is formed with a larger mesh and from larger diameter wire than the screens conventionally used on dandy rolls. Conventional dandy rolls are designed to smooth the paper and are constructed with screens having a relatively small mesh (e.g., 35 to 40 mesh) which does not mark the paper. By using a larger mesh and a larger wire in the present invention, a composite watermark having translucent and opaque points is imparted to the paper. Preferably, the outer grid 26 is formed from approximately 0.027 inch (0.686 mm) diameter metallic strand. As shown in FIG. 2, the outer grid 26 comprises a rectangular grid pattern in which alternate intersections are provided with diamond shapes 32. The diamond shapes 32 have a major axis and a minor axis, wherein the major axis is about 3 mm and the minor axis is about 2 mm. Typically, the ratio of the major axis to the minor axis is about 3 to 2. Preferably, in mounting the outer grid 26 on the dandy roll 18 the major axis runs parallel to the machine direction.

In FIG. 1, the translucent lines 12 and translucent diamond shapes 14 are formed by the wire of the outer grid 26 and the "shaded marks" 16 are formed by the pockets 33 in the outer grid 26. This outer grid 26 is a deviation from standard practice whereby the outer grid typically comprises a woven wire mesh outer cover. Preferably, the outer grid 26 is produced by etching the rectangular grid pattern into a magnesium plate. Preferably, the depth of the pattern in the magnesium plate is about 0.027 inch. However, other suitable depths for the pattern can be used. After the pattern is etched into the magnesium plate, the plate is then placed on a sheet of wax and pressure is applied to the plate such that an impression of the pattern is imparted to the wax. The plate is removed and the sheet of wax, including the impression, is sprayed with silver. After deposition of the silver, a blade or some other suitable tool is used to scrape away and remove any excess silver on the surface of the sheet of wax so that only the silver deposited in the impression in the form of a metallic grid remains. Next, a copper strip is placed in electrical contact with an edge of the silver, and in a conventional electrolysis, copper is deposited on the silver. The electrolysis is conducted until all or substantially all of the silver is covered by the copper. After copper deposition is complete, the sheet of wax is removed from the metallic grid with hot water. The end product is a copper-covered grid. At this point, the copper-covered grid is tinned with a solder of tin/lead alloy and is soldered to the inner wire mesh cover 24.

For illustration purposes only, in FIG. 2, the top-to-bottom direction is the machine direction and the left-to-right direction is the cross-machine direction. The outer grid 26 comprises a first set of parallel metallic strands and a second set of parallel metallic strands that is normal to the first set. Adjacent strands of the first set of parallel metallic strands are spaced apart from each other a distance less than the distance adjacent strands of the second set of parallel metallic strands are spaced apart, thus forming a rectangular grid. For example, the distance between two adjacent parallel strands running in the machine direction, distance a, can be any suitable distance, but preferably is about 3 mm. The distance between two adjacent parallel strands running in the cross-machine direction, distance b, can be any suitable distance, but preferably is about 5 mm. Typically, the ratio of distance a to distance b is about 3 to 5. Notwithstanding the above example, the machine direction and cross-machine direction can be the reverse of that shown in FIG. 2.

It has previously been known to construct screens such that maximum contact areas were placed adjacent to the dandy roll surface in order to minimize screen wear, thus increasing the life of the paper machine wire. The present invention is further distinguished from the standard woven wire mesh covers in that a larger portion of the outer grid surface is in contact with the underlying dandy roll structure via the inner wire mesh cover, thus promoting longer life. In accordance with the preferred embodiments of the present invention, the outer grid 26 is in contact with the inner wire mesh cover 24, as shown in FIG. 3. When affixed to the dandy roll 18 as shown in FIG. 4, the grid pattern on the outer grid makes an impression on the paper surface.

Having described the invention in detail and by reference to specific embodiments thereof, it will be apparent that numerous variations and modifications are possible without departing from the spirit and scope of the invention as defined by the appended claims.

What is claimed is:

1. A dandy roll comprising a cylindrical dandy roll frame, an inner screen mounted to the cylindrical frame and extending around the cylindrical frame, an integrally formed outer grid connected over and positioned adjacent the inner screen, the integrally formed outer grid defined by a first set of substantially parallel grid strands extending in a first direction around the cylindrical frame, the first set of substantially parallel grid strands intersecting a second set of substantially parallel grid strands which extend in a second direction from end to end of the cylindrical frame, the first set of substantially parallel grid strands running substantially perpendicular to the second set of substantially parallel grid strands, each grid strand of the first set of substantially parallel grid strands having a diamond-shaped formation present at every other point at which it intersects a grid strand of the second set of substantially parallel grid strands, each grid strand of the second set of substantially parallel grid strands having a diamond-shaped formation present at every other point at which it intersects a grid strand of the first set of substantially parallel grid strands, said outer grid extending about substantially the entire outer cylindrical surface portion of the dandy roll to create a continuous repeating pattern thereabout, wherein a distance between adjacent grid strands of the first set of substantially parallel grid strands is about 3 mm and a distance between adjacent grid strands of the second set of substantially parallel grid strands is about 5 mm, wherein a width of each grid strand of the integrally formed outer grid is about 0.68 mm, and wherein each diamond-shaped formation includes a major axis running parallel to the first set of substantially parallel grid strands and a minor axis running parallel to the second set of substantially parallel grid strands, a length of the major axis of each diamond-shaped formation being about 3 mm and a length of the minor axis of each diamond-shaped formation being about 2 mm.

* * * * *